US010640257B1

(12) United States Patent
Kraus et al.

(10) Patent No.: US 10,640,257 B1
(45) Date of Patent: May 5, 2020

(54) SHIPPING PACKAGE FOR AN ELONGATED ARTICLE

(71) Applicant: Green Bay Packaging, Inc., Green Bay, WI (US)

(72) Inventors: Michael Kraus, Jackson, WI (US); Rick Jalling, Waupaca, WI (US)

(73) Assignee: Green Bay Packaging, Inc., Green Bay, WI (US)

( * ) Notice: Subject to any disclaimer, the term of this patent is extended or adjusted under 35 U.S.C. 154(b) by 8 days.

(21) Appl. No.: 15/912,786

(22) Filed: Mar. 6, 2018

Related U.S. Application Data

(60) Provisional application No. 62/468,495, filed on Mar. 8, 2017.

(51) Int. Cl.

| | |
|---|---|
| ***B65D 5/50*** | (2006.01) |
| ***B65D 5/42*** | (2006.01) |
| ***B65B 23/22*** | (2006.01) |
| ***B65B 5/04*** | (2006.01) |
| ***B65D 85/42*** | (2006.01) |

(52) U.S. Cl.
CPC ..... *B65D 5/5016* (2013.01); *B65B 5/04* (2013.01); *B65B 23/22* (2013.01); *B65D 5/4266* (2013.01); *B65D 85/42* (2013.01)

(58) Field of Classification Search
CPC ..... B65D 5/5016; B65D 5/04; B65D 5/4266; B65D 85/42
USPC ..... 229/108–116, 101; 206/418, 521–594
See application file for complete search history.

(56) References Cited

U.S. PATENT DOCUMENTS

| | | | | | |
|---|---|---|---|---|---|
| 1,423,272 | A * | 7/1922 | Steudel | B65D 5/04 | 229/101 |
| 2,841,320 | A * | 7/1958 | Currivan | B65D 5/5016 | 206/591 |
| 3,050,231 | A * | 8/1962 | Bolding | B65D 5/5016 | 206/591 |
| 3,059,830 | A * | 10/1962 | Kramer | B65D 5/5016 | 206/418 |
| 3,115,290 | A * | 12/1963 | Byassee | B65D 5/48014 | 206/591 |
| 3,217,960 | A * | 11/1965 | Davis | B65D 5/5016 | 206/591 |
| 3,891,136 | A * | 6/1975 | Woeste | B65D 85/671 | 229/115 |
| 3,968,924 | A * | 7/1976 | Tyrseck | B65D 5/5016 | 206/418 |
| 4,260,059 | A * | 4/1981 | Roccaforte | B65D 5/5016 | 206/418 |
| 4,498,580 | A * | 2/1985 | Getz | B65D 5/5016 | 206/418 |
| 4,834,239 | A | 5/1989 | Osgood | | |

(Continued)

*Primary Examiner* — Chun Hoi Cheung
(74) *Attorney, Agent, or Firm* — Boyle Fredrickson, S.C.

(57) ABSTRACT

A shipping package comprising for an elongated article includes an outer portion having a series of walls that cooperate to define a cavity, an article receiving portion that defines a passage within which the elongated article is received, and a transition portion between the outer portion and the article receiving portion. The transition portion suspends the article within the cavity such that the article is spaced from inner surfaces defined by walls. The outer portion, the article receiving portion and the transition portion may be formed integrally with each other from a single blank of material.

16 Claims, 11 Drawing Sheets

(56) References Cited

U.S. PATENT DOCUMENTS

| | | | | |
|---|---|---|---|---|
| 5,038,939 | A * | 8/1991 | Van Hest | B65D 5/5061<br>206/418 |
| 5,145,070 | A | 9/1992 | Pallett et al. | |
| 5,503,273 | A | 4/1996 | Fiebig et al. | |
| 5,826,722 | A | 10/1998 | Phillips | |

* cited by examiner

SHIPPING PACKAGE FOR AN ELONGATED ARTICLE

CROSS-REFERENCE TO RELATED APPLICATIONS

This application claims the benefit of and priority from provisional patent application Ser. No. 62/468,495 filed Mar. 8, 2017, the entire contents of which is hereby expressly incorporated by reference.

BACKGROUND AND SUMMARY

A number of challenges are involved in packaging and shipping elongated articles, especially those that are fragile, such as fluorescent tubes. Many solutions have been attempted but, to date, even the most optimal solutions result in a significant percentage of articles reaching their destination in broken or damaged condition. The present invention addresses drawbacks in existing packaging for use in shipping elongated articles.

In accordance with one aspect of the present invention, a shipping package for an elongated article that extends along a longitudinal includes an outer portion having a series of walls that cooperate to define a cavity that extends along the longitudinal axis, an article receiving portion that defines a passage within which the elongated article is received, and a transition portion positioned between the outer portion and the article receiving portion. The transition portion is interconnected with and extends from the outer portion and is interconnected with the article receiving portion, and is configured and arranged to suspend the article receiving portion within the cavity such that the article receiving portion is spaced from inner surfaces defined by the series of walls. Representatively, the article receiving portion and the transition portion may be formed integrally with each other and the outer portion and the transition portion may be formed integrally with each other. In one embodiment, the article receiving portion, the transition portion and the outer portion are formed integrally with each other from a single blank of material.

The article receiving portion may be in the form of a series of foldable panel sections that are configured to be wrapped about the article. A tab and slot arrangement may be provided for securing the foldable panel sections about the article. In one form, the tab and slot arrangement may include at least one tab and at least one set of slots that are spaced apart from each other, with the tab being positionable within a selected one of the slots to vary a transverse dimension defined by the passage according to a transverse dimension defined by the article.

The transition portion may be in the form of one or more panels that are interconnected with and extend between the article receiving portion and one of the walls of the outer portion.

The present invention also contemplates a method of packaging an elongated article within a shipping package. This aspect of the invention contemplates positioning the article within a passage defined by an article receiving portion of the shipping package, with the article receiving portion of the shipping package being interconnected with a transition portion of the shipping package. An outer portion of the package is then formed about the transition portion and the article receiving portion such that the article receiving portion is positioned within an interior defined by a series of walls defined by the outer portion of the package. The transition portion of the package is positioned relative to the outer portion of the package, so as to suspend the article receiving portion of the package within the interior of the outer portion, with the article receiving portion of the package being spaced from inner surfaces defined by the walls of the outer portion of the package.

The present invention further contemplates a blank for use in forming a shipping package for an elongated article. The blank includes a first series of sections that are interconnected with each other and that have a first set of parallel fold lines therebetween, and a second series of sections that are interconnected with each other and that have a second set of parallel fold lines therebetween. The first and second sets of parallel fold lines are parallel to each other. The first series of sections are configured to be positioned about the article and to define an elongated passage within which the article is received, and the blank further includes an engagement arrangement that is configured to secure the first series of sections about the article. Representatively, the engagement arrangement may be in the form of a tab member and two or more slots, each of which is configured to receive the tab member, with the tab member being positioned within one or the other of the slots according to a transverse dimension of the article about which the first series of sections are positioned. The second series of sections are configured to be positioned about the article and the first series of sections to form an exterior of the shipping package.

Other aspects, features, and advantages of the present invention will become apparent from the following detailed description and accompanying drawings. It should be understood, however, that the detailed description and specific examples, while indicating certain embodiments of the present invention, are given by way of illustration and not of limitation. Many changes and modifications may be made within the scope of the present invention without departing from the spirit thereof, and the invention includes all such modifications.

BRIEF DESCRIPTION OF THE FIGURES

A clear conception of the advantages and features constituting the present invention, end of the construction and operation of the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
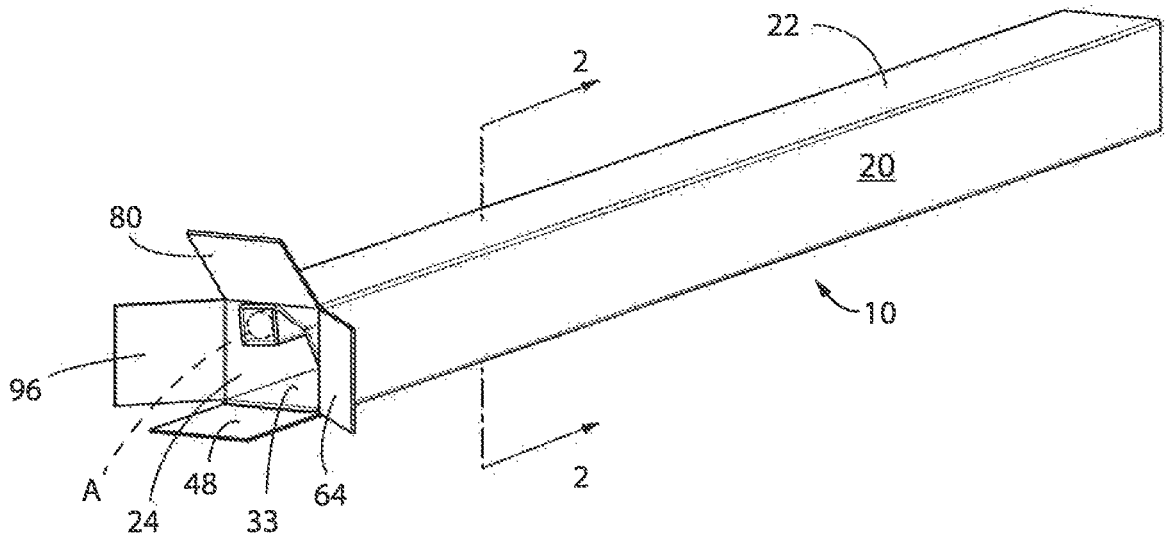
FIG. 1 is an isometric view of a shipping container for an elongated article, according to an embodiment of the invention.

In describing the embodiment of the invention which is illustrated in the drawings, specific terminology will be resorted to for the sake of clarity. However, it is not intended that the invention be limited to the specific terms so selected, and it is to be understood that each specific term includes all technical equivalents which operate in a similar manner to accomplish a similar purpose. For example, the word connected, attached or terms similar thereto are often used. Such words are not limited to direct connection but include connection through other elements were such connection is recognized as being equivalent by those skilled in the art.

DETAILED DESCRIPTION OF THE FIGURES

The various features and advantageous details of the subject matter disclosed herein are explained more fully with reference to the non-limiting embodiment described in detail in the following description.

Figure 2:
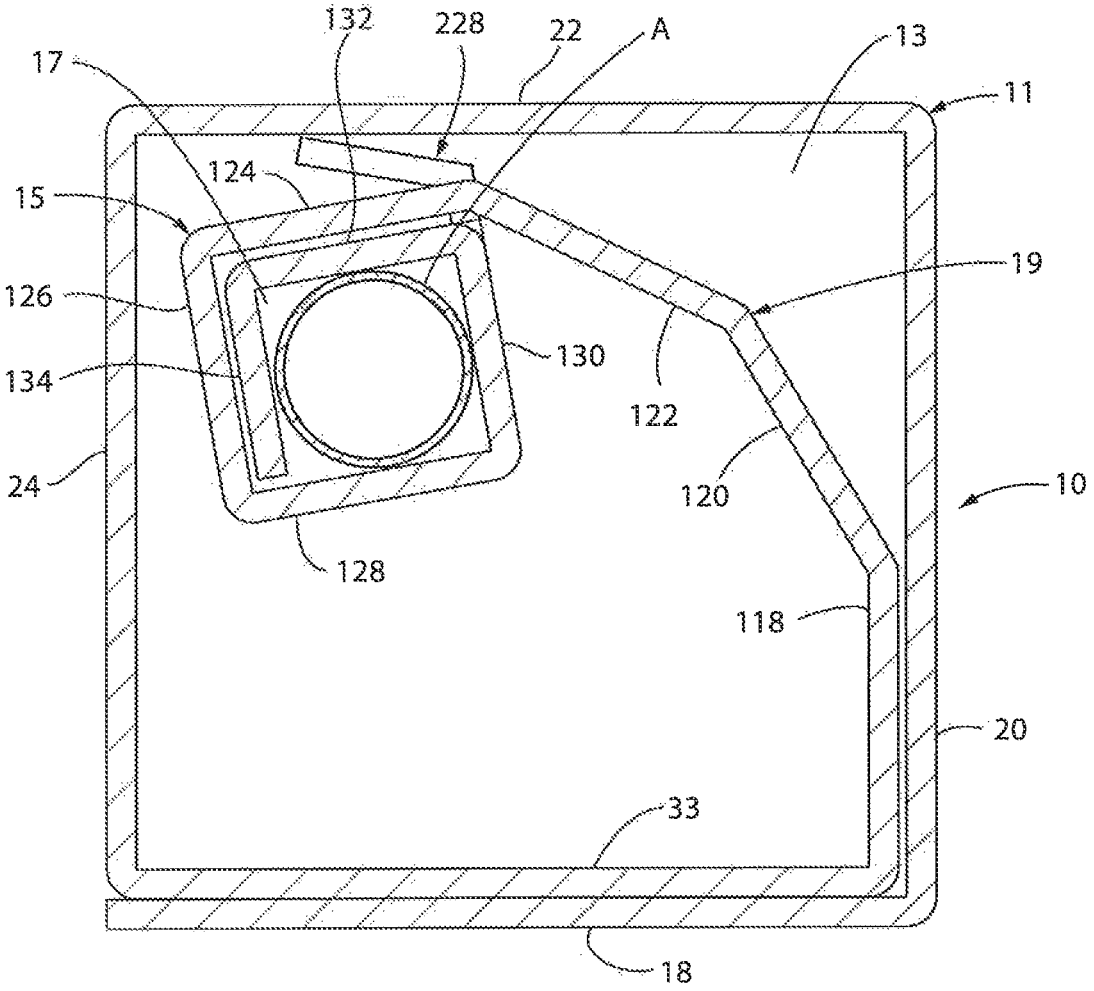
FIG. 2 is a section view taken along line 2-2 of FIG. 1.

Referring first to FIGS. 1 and 2, a carton or container for use in shipping or storing an elongated article A is shown generally at 10. The container 10 is well suited for shipping and storage of an individual elongated article A that is fragile and susceptible to damage or breakage such as, but not limited to, a fluorescent lamp or tube. While the drawings and description relate to packaging of a single article A within the container 10, it is contemplated that the more than one article A may be placed within the container 10, with the individual articles A preferably being protected from each other. Generally, the container 10 includes an outer portion 11 having a series or walls the cooperate to define an interior or cavity 13 that extends along a longitudinal axis, an article receiving portion 15 that defines a passage 17 within which the article A is positioned, and a transition portion 19 that is positioned between the outer portion 11 and the article receiving portion 15. In a manner to be explained, the transition portion 19 is interconnected with and extends from the outer portion 11, and is configured and arranged to suspend the article receiving portion 15 within the cavity 13 such that the article receiving portion 15 is spaced from inner surfaces defied by the walls of the outer portion 11.

Figure 3:
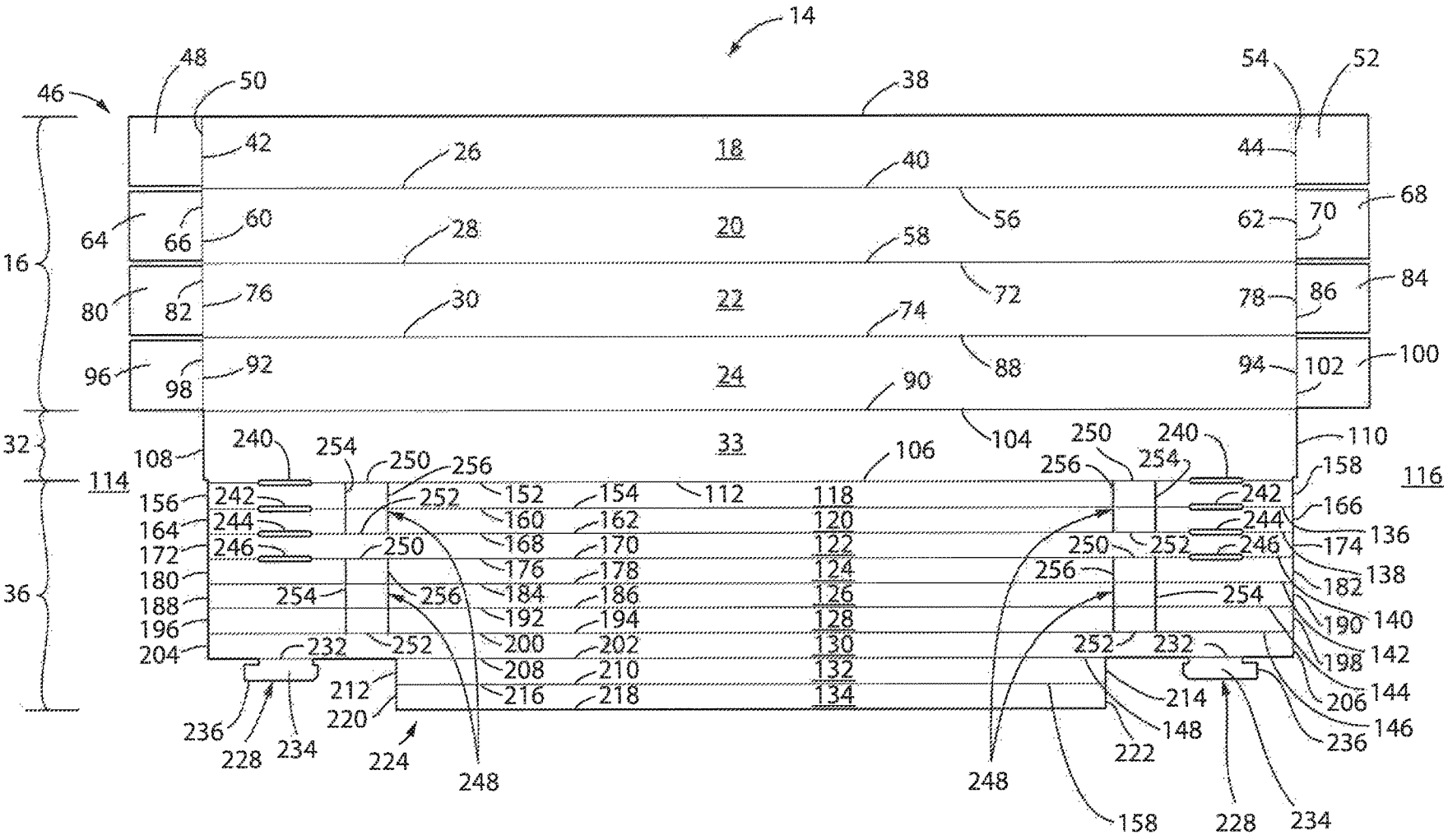
FIG. 3 is a plan view of a blank for use in constructing the shipping container of FIG. 1, according to an embodiment of the invention.

FIG. 3 illustrates a top view of a blank 14 from which container 10 is constructed, with the blank 14 being shown in an unfolded configuration. The blank 14 includes a series of panels or sections and fold lines, which will be described in further detail below.

In a representative embodiment of the invention as shown, the blank 14 includes an outer area 16 divided into four (4) outer sections: a first outer section 18, a second outer section 20, a third outer section 22, and a fourth outer section 24. Each outer section is separated from the adjacent outer section by way of a fold line. For example, the first outer section 18 and the second outer section 20 are divided by a first outer fold line 26, the second outer section 20 and the third outer section 22 are divided by a second outer fold line 28, and the third outer section 22 and the fourth outer section 24 are divided by a third outer fold line 30. Additionally, the fourth outer section 24 is adjacent a transition area 32 having a transition panel or section 33, which is separated from fourth outer section 24 by a fourth outer fold line 34.

The blank 14 also includes an inner area 36 having a number of panels or sections, which will be described in further detail below.

The first outer section 18 includes edges 38, 40, 42, 44. The first edge 38 is located at a first end 46 of the blank 14. The first outer fold line 26 is located at the second edge 40 of the first outer section 18. A first left end section 48 is disposed adjacent the first outer section 18 along third edge 42. The first left end section 48 is separated from the first outer section 18 by way of a first left end fold line 50 located along the third edge 42. Similarly, a first right end section 52 is disposed adjacent the first outer section 18 along the fourth edge 44. The first right end section 52 is separated from the first outer section 18 by way of a first right end fold line 54 located along the fourth edge 44.

The second outer section 20 includes edges 56, 58, 60, 62. The first edge 56 of the second outer section 20 abuts the second edge 40 of the first outer section 18 at the first outer fold line 26. The second outer fold line 28 is located at the second edge 58 of the second outer section 18. A second left end section 64 is disposed adjacent the second outer section 20 along the third edge 60. The second left end section 50 is separated from the second outer section 18 by way of a second left end fold line 66 located along the third edge 60. Likewise, a second right end section 68 is disposed adjacent the second outer section 20 along the fourth edge 62. The second right end section 68 is separated from the second outer section 20 by way of a second right end fold line 70 located along the fourth edge 62.

The third outer section 22 includes edges 72, 74, 76, 78. The first edge 72 of the third outer section 22 abuts the second edge 58 of the second outer section 20 at the second outer fold line 28. The third outer fold line 30 is located at the second edge 74 of the third outer section 22. A third left end section 80 is disposed adjacent the third outer section 22 along the third edge 76. The third left end section 80 is separated from the third outer section 22 by way of a third left end fold line 82 located along the third edge 76. Similarly, a third right end section 84 is disposed adjacent the third outer section 22 along the fourth edge 78. The third right end section 84 is separated from the third outer section 22 by way of a third right end fold line 86 located along the fourth edge 78.

The fourth outer section 24 includes edges 88, 90, 92, 94. The first edge 88 of the fourth outer section 24 abuts the second edge 74 of the third outer section 22 at the third outer fold line 30. The fourth outer fold line 32 is located at the second edge 90 of the fourth outer section 24. A fourth left end section 96 is disposed adjacent the fourth outer section 24 along the third edge 92. The fourth left end section 96 is separated from the fourth outer section 24 by way of a fourth left end fold line 98 located along the third edge 92. Likewise, a fourth right end section 100 is disposed adjacent the fourth outer section 24 along the fourth edge 94. The fourth right end section 100 is separated from the fourth outer section 24 by way of a fourth right end fold line 102 located along the fourth edge 94.

The transition area 32 includes transition panel or section 33 having edges 104, 106, 1108, 110. The first edge 104 of the transition section 33 abuts the second edge 90 of the fourth outer section 24 of the outer portion 16 at the fourth outer fold line 34. The second edge 106 of the transition section 103 abuts the inner area 36 of the blank 14 along a first inner fold line 112. The third edge 108 of the transition section 33 is located at a left end 114 of the blank 14 and container 10. The fourth edge 110 of the transition portion 32 is located at a right end 116 of the blank 14 and container 10.

In the above descriptions and in the descriptions that follow, the terms "right" and "left" are used solely for purposes of convenience to facilitate clarity of the description, and are not meant to limit the blank 14 or how the blank 14 can be oriented.

In the representative embodiment of the invention, the inner area 36 of the blank 14 comprises nine (9) inner sections: a first inner section 118, a second inner section 120, a third inner section 122, a fourth inner section 124, a fifth inner section 126, a sixth inner section 128, a seventh inner section 130, an eighth inner section 132, and a ninth inner section 134.

Each inner section is separated from the adjacent inner section by way of a fold line. For example, the first inner section 118 and the second inner section 120 are divided by a second inner fold line 136, the second inner section 120 and the third inner section 122 are divided by a third inner fold line 138, the third inner section 122 and the fourth inner section 124 are divided by a fourth inner fold line 140, and the fourth inner section 124 and the fifth inner section 126 are divided by a fifth inner fold line 142. In addition, the fifth inner section 126 and the sixth inner section 128 are divided by a sixth inner fold line 144, the sixth inner section 128 and the seventh inner section 130 are divided by a seventh inner fold line 146, the seventh inner section 130 and the eighth inner section 132 are divided by an eighth inner fold line 148, and the eighth inner section 132 and the ninth inner section 134 are divided by a ninth inner fold line 150. The first inner section 118 includes edges 152, 154, 156, 1158. The first edge 152 of the first inner section 118 abuts the second edge 106 of the transition portion 32 at the first inner fold line 112. The second inner fold line 136 described above is located at the second edge 154 of the first inner section 1:18. The third edge 156 of the first inner section 118 is located adjacent the left end 114 of the container 10. The fourth edge 158 of the first inner section 118 is located adjacent the right end 116 of the container 10.

The second inner section 120 includes edges 160, 162, 164, 166. The first edge 160 of the second inner section 120 abuts the second edge 154 of the first inner section 118 at the second inner fold line 136. The third inner fold line 138 listed above is located at the second edge 162 of the second inner section 120. The third edge 164 of the second inner section 120 is located adjacent the left end 114 of the container 10. The fourth edge 166 of the second inner section 120 is located adjacent the right end 116 of the container 10.

The third inner section 122 includes edges 168, 170, 172, 174. The first edge 168 of the third inner section 122 abuts the second edge 162 of the second inner section 120 at the third inner fold line 138. The fourth inner fold line 140 mentioned above is located at the second edge 170 of the third inner section 122. The third edge 172 of the third inner section 122 is located adjacent the left end 114 of the container 10. The fourth edge 174 of the third inner section 122 is located adjacent the right end 116 of the container 10.

The fourth inner section 124 includes edges 176, 178, 180, 182. The first edge 176 of the fourth inner section 124 abuts the second edge 170 of the third inner section 122 at the fourth inner fold line 140. The fifth inner fold line 142 described above is located at the second edge 178 of the fourth inner section 124. The third edge 1180 of the fourth inner section 124 is located adjacent the left end 114 of the container 10. The fourth edge 182 of the fourth inner section 124 is located adjacent the right end 116 of the container 10.

The fifth inner section 126 includes edges 184, 186, 188, 190. The first edge 184 of the fifth inner section 126 abuts the second edge 178 of the fourth inner section 124 at the fifth inner fold line 142. The sixth inner fold line 144 listed above is located at the second edge 186 of the fifth inner section 126. The third edge 188 of the fifth inner section 126 is located adjacent the left end 114 of the container 10. The fourth edge 190 of the fifth inner section 126 is located adjacent the right end 116 of the container 10.

The sixth inner section 128 includes edges 192, 194, 196, 198. The first edge 192 of the sixth inner section 128 abuts the second edge 186 of the fifth inner section 126 at the sixth inner fold line 144. The seventh inner fold line 146 discussed above is located at the second edge 194 of the sixth inner section 126. The third edge 196 of the sixth inner section 128 is located adjacent the left end 114 of the container 10. The fourth edge 198 of the sixth inner section 128 is located adjacent the right end 116 of the container 10.

The seventh inner section 130 includes edges 200, 202, 204, 206. The first edge 200 of the seventh inner section 130 abuts the second edge 194 of the sixth inner section 128 at the seventh inner fold line 146. The eighth inner fold line 148 listed above is located at the second edge 202 of the seventh inner section 130. The third edge 204 of the seventh inner section 130 is located adjacent the left end 114 of the container 10. The fourth edge 206 of the seventh inner section 130 is located adjacent the right end 116 of the container 10.

The eighth inner section 132 includes edges 208, 210, 212, 214. The first edge 208 of the eighth inner section 132 abuts the second edge 202 of the seventh inner section 130 at the eighth inner fold line 148. The ninth inner fold line 150 mentioned above is located at the second edge 210 of the eighth inner section 132. The third edge 212 of the eighth inner section 132 is spaced apart from the left end 114 of the container 10. The fourth edge 214 of the eighth inner section 132 is spaced apart from the right end 116 of the container 10.

The ninth inner section 134 includes edges 216, 218, 220, 222. The first edge 216 of the ninth inner section 134 abuts the second edge 210 of the eighth inner section 132 at the ninth inner fold line 150. The second edge 218 of the ninth inner section 134 is located at a second end 224 of the blank 14. The third edge 220 of the ninth inner section 134 is spaced apart from the left end 114 of the container 10. The fourth edge 222 of the ninth inner section 134 is spaced apart from the right end 116 of the container 10.

While FIG. 1 illustrates the blank 14 having four (4) outer sections and nine (9) inner sections, it is contemplated that other embodiments of the invention may have any number of outer sections and inner sections. As such, embodiments of the container 10 are not limited to the configuration and rectangular shape shown in FIG. 2. That is, other embodiments of the container 10 may be in the shape of a triangle, pentagon, hexagon, heptagon, octagon, and so on.

The blank 14 further includes a tab and slot arrangement for use in securing article A when in a folded engaged position, as will later be described. In the representative embodiment of the invention, the inner portion 36 of the blank 14 includes two (2) tabs 228, and each tab 228 extends from the second edge 202 of the seventh inner section 130. In alternative embodiments of the invention, more or less than two (2) tabs 228 may be used. In addition, each tab 228 may abut the second edge of any inner section. As shown in FIG. 3, one of the tabs 228 is disposed along the second edge 202 of the seventh inner section 130 at a location between the third edge 204 of the seventh inner section 130 and the third edge 210 of the eighth inner section 132. Another of the tabs 228 is disposed along the second edge 202 of the seventh inner section 130 at a location between the fourth edge 206 of the seventh inner section 130 and the fourth edge 212 of the eighth inner section 132. Each tab 228 is separated from the seventh inner section 130 by way, of a tab fold line 232. Each tab 228 further includes a main portion 234 and a lock portion 236. The design and function of the main portion 234 and the lock portion 236 of each tab 228 will be described later in further detail.

In the representative embodiment of the invention, the blank 14 includes a first set of slots 240 disposed along the first inner fold line 112, a second set of slots 242 disposed along the second inner fold line 136, a third set of slots 244 disposed along the third inner fold line 138, and a fourth set of slots 246 disposed along the fourth inner fold line 140. In particular, each set of slots includes a respective slot for each tab 228. For example, if there are two (2) tabs, each set of slots includes two (2) slots, if there are three (3) tabs, each set of slots includes three (3) slots, and so on. While FIG. 3 illustrates the use of four (4) pairs of slots, other embodiments may use more or less than four (4) pairs of slots. Additionally, each slot in each set of slots is located along its respective inner fold line at a location aligned with its respective tab 228.

The blank 14 also includes a series of positioning sections 248 defined by transverse cut lines. Each positioning section 248 includes edges 250, 252, 254, 256, with edges 254 and 256 being formed by the transverse cut lines. The first and second edges 250, 252 are aligned with non-adjacent inner fold lines, so that another inner fold line is disposed within the positioning section 248. For instance, the first edge 250 of the positioning section 248 may align with the first inner fold line 112 and the second edge 252 of the positioning section 248 may align with the third inner fold line 138, so that the second inner fold line 236 is disposed within the positioning section 248. As a result, each positioning section 248 is able to be folded along the at least one inner fold line disposed within the positioning section 248 in a direction independent from the rest of the inner area 36.

It should be noted that the positioning sections 248 illustrated in FIG. 3 are not limited to the depicted locations, and may be located on any of the inner sections. In addition, alternative embodiments of the invention may include more or less than four (4) positioning sections 248.

FIG. 1 depicts an isometric view of the container 10 in a folded configuration about the article A. When in the folded configuration, the outer area 16 is formed such that the first outer section 18 forms one wall of the container 10, the second outer section 20 forms another wall, the third outer section 22 forms another wall, and the fourth outer section 24 forms yet another wall by folding the outer sections along their adjacent outer fold lines. The left end 114 of the container 10 is enclosed by the first, second, third, and fourth left end sections 48, 64, 80, 96. That is, the first, second, third, and fourth left end sections 48, 64, 80, 96 are folded along their respective left end fold lines 50, 66, 82, 98 and adhered together. Similarly, the right end 116 of the container 10 is enclosed by the first, second, third, and fourth right end sections 52, 68, 84, 100, respectively, being folded along their respective right end fold lines 54, 70, 86, 102, respectively, and adhered together.

FIGS. 4-21 illustrate in a sequential manner how the blank 14 is utilized to secure, protect and enclose article A for storage or shipment.

Figure 4:
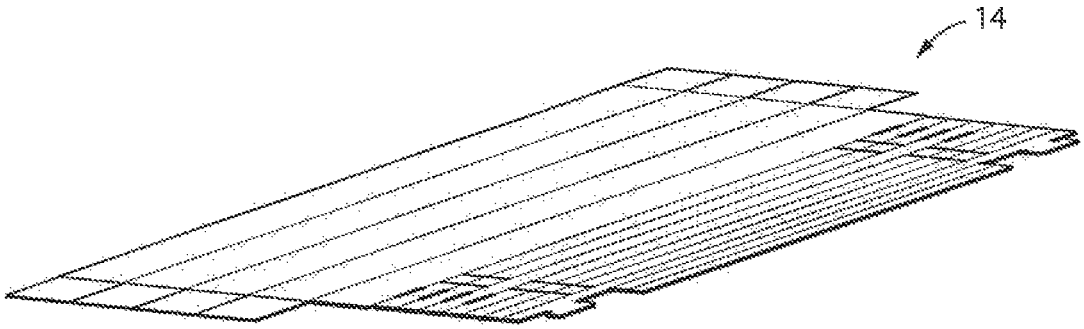
FIG. 4 is an isometric view of the shipping container blank of FIG. 3.
Figure 5:
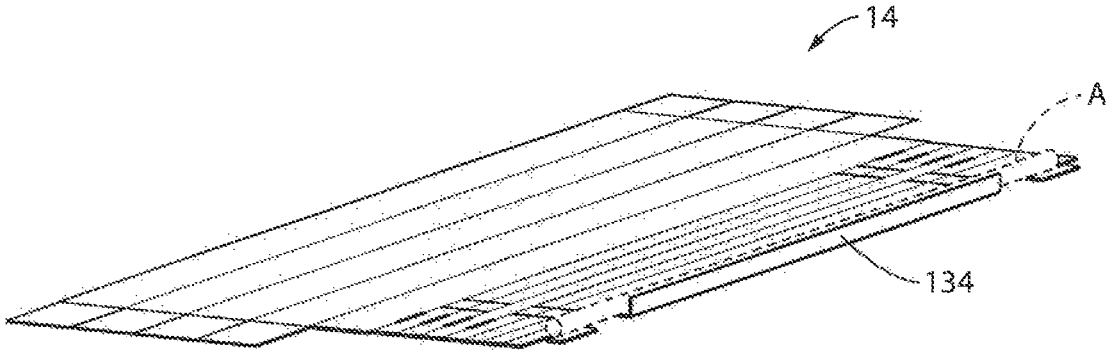
FIGS. 5-21 are progressive isometric views showing the manner in which the blank of FIGS. 3 and 4 is engaged with an elongated article and constructed into a package or container for and around the elongated article.
Figure 6:
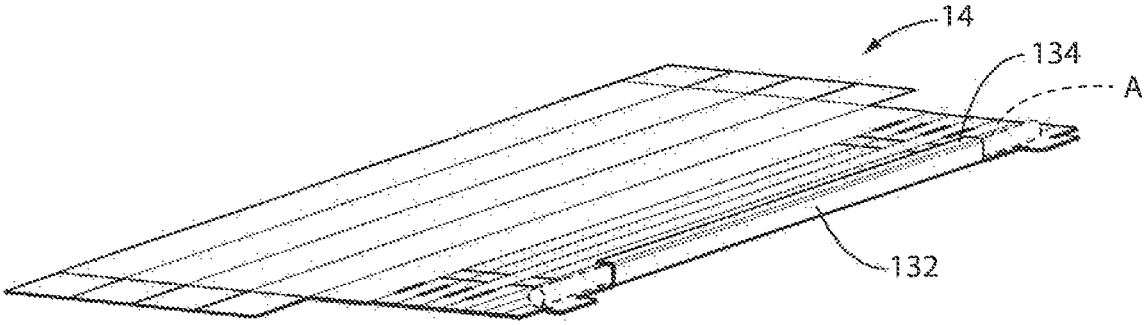
Figure 7:
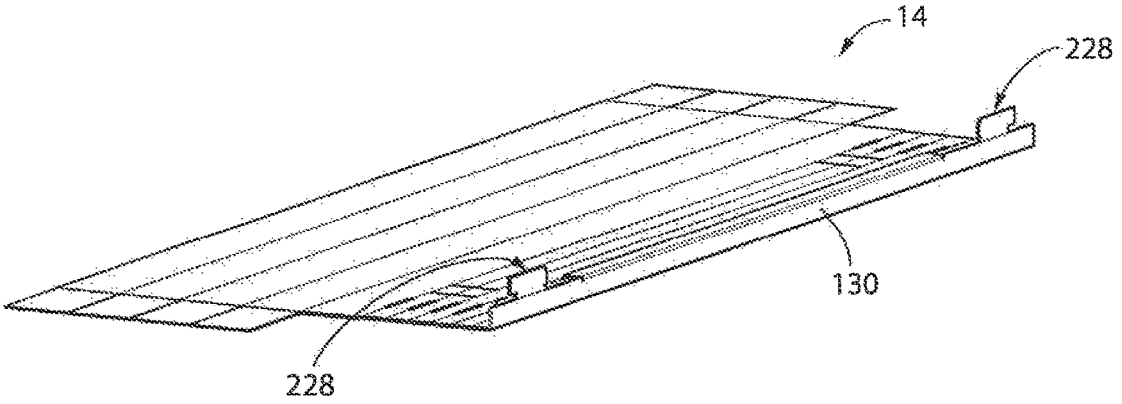
Figure 8:
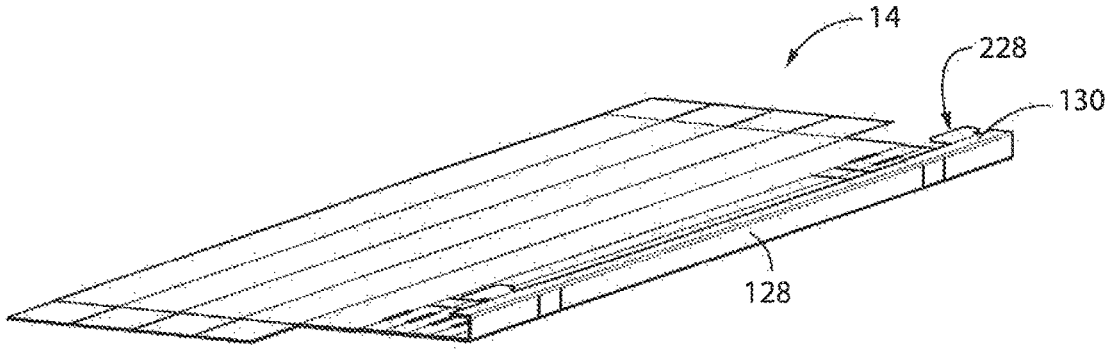
Figure 9:
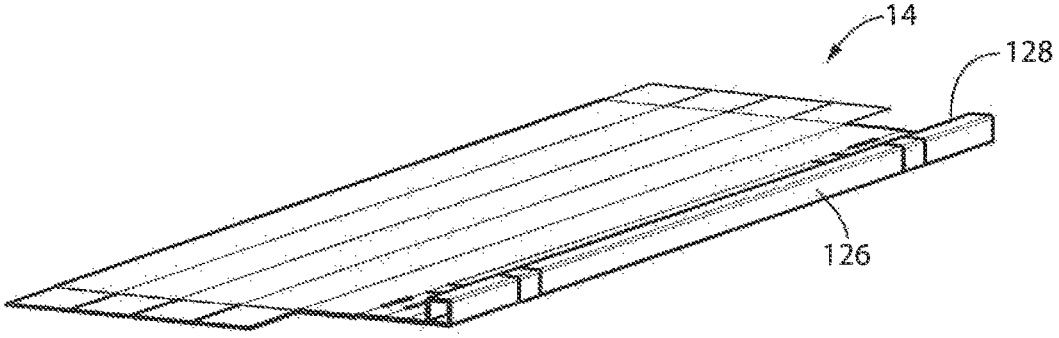
Figure 10:
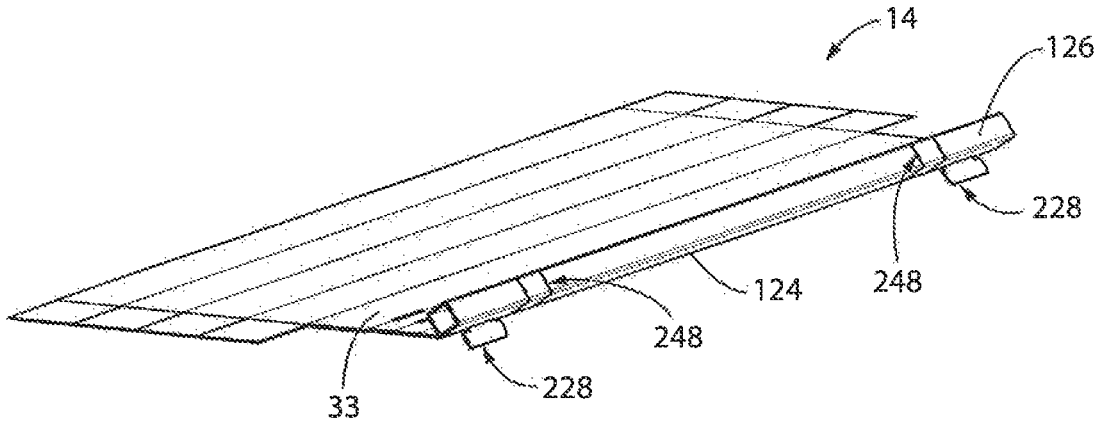
Figure 11:
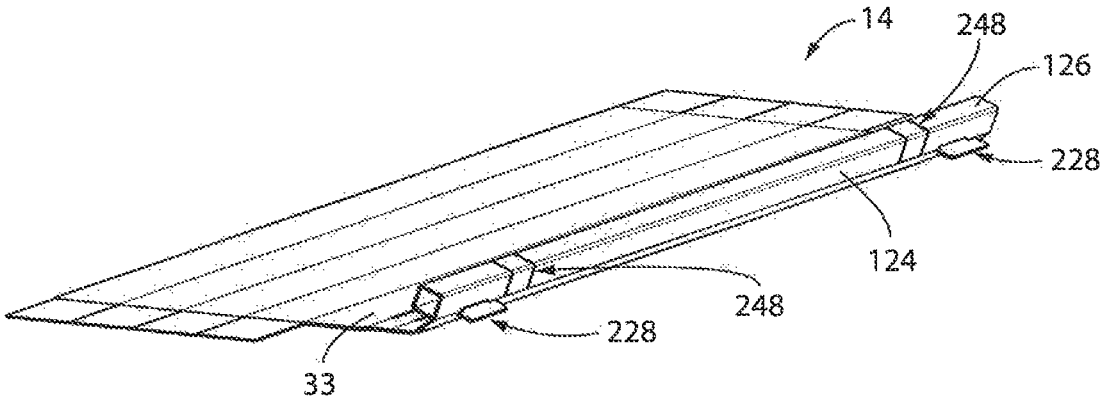

FIG. 4 illustrates blank 14 positioned flat on a surface in preparation for use. As shown in FIG. 5, article A, which may the encased within a protective material such as bubble wrap, is placed on the endmost sections 132, 134, and section 134 is pivoted about fold line 150 upwardly along the side of article A. As shown in FIG. 6, section 132 is then pivoted upwardly about fold line 148 while section 134 is maintained in engagement with article A. The sections of blank 14 are continued to be sequentially folded and wrapped about article A, as shown in FIGS. 7, 8 and 9. This action continues until the tabs 228 are advanced toward an appropriate set of slots according to the diameter of the article A. With a relatively small diameter article A as shown, the tabs 228 are inserted through the closest set of slots, shown at 246, so as to secure the article A within a passage, shown in FIG. 2 at 17, defined by the folded and rolled sections 124, 126, 128, 138, 132 134. The tabs 228 are inserted through the slots 246 by bending the tab lock portions 236 against the tab main portions 234 to enable the tabs to 28 to pass through the slats 246 and then returning the tab lock portions 236 toward their original positions, to prevent the tabs to 28 from being withdrawn through the slots 246. If the article A has a larger diameter or transverse dimension, the tabs 228 are inserted through and secured within a different set of slots such as 246, 244, 242 or 240 according to the diameter of the article A. In the illustrated embodiment, FIG. 10 shows the tabs 228 having been inserted through the slots 246 so as to secure the article A within the passage 17 defined by the folded and rolled sections.

Figure 12:
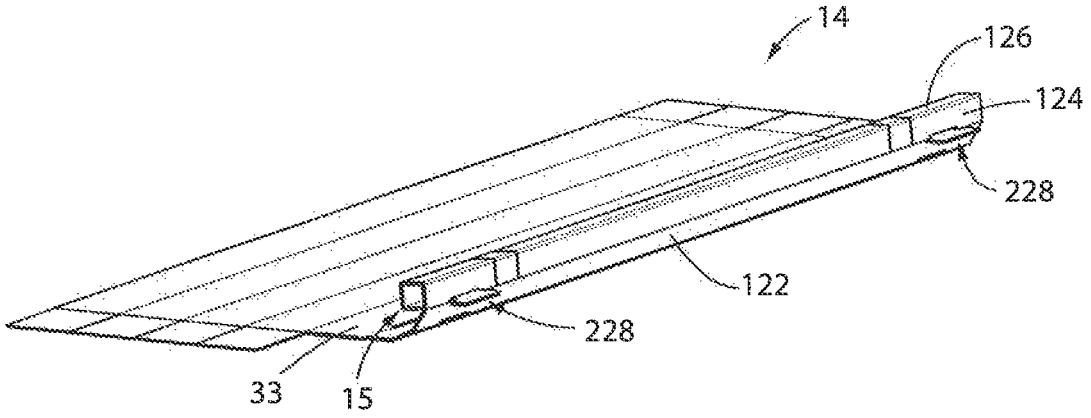
Figure 13:
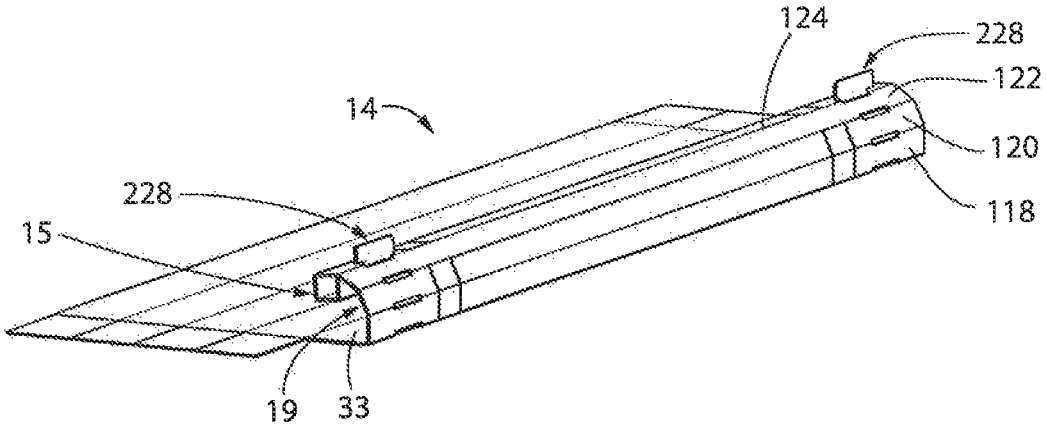
Figure 14:
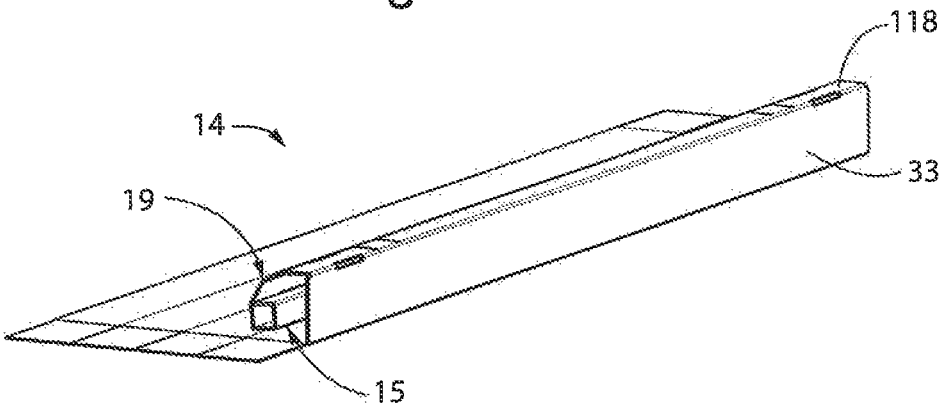
Figure 15:
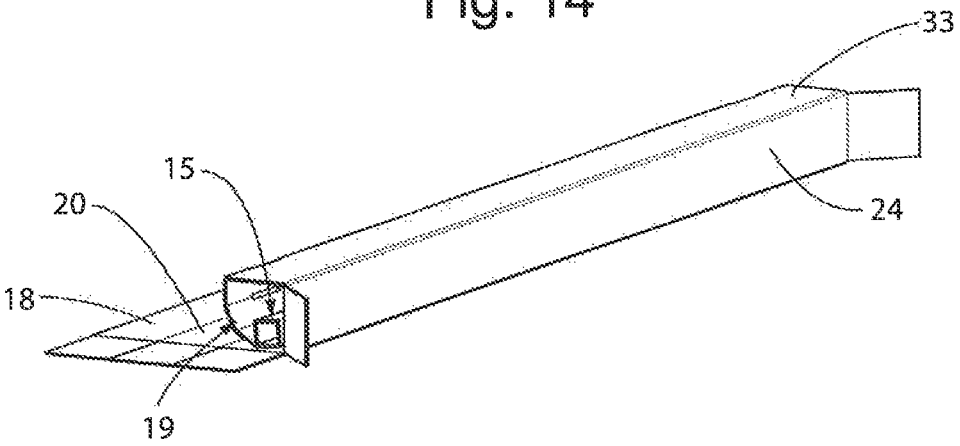
Figure 16:
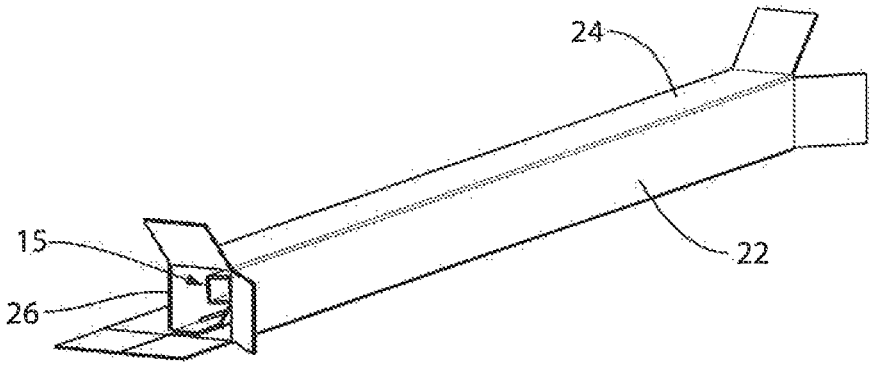
Figure 17:
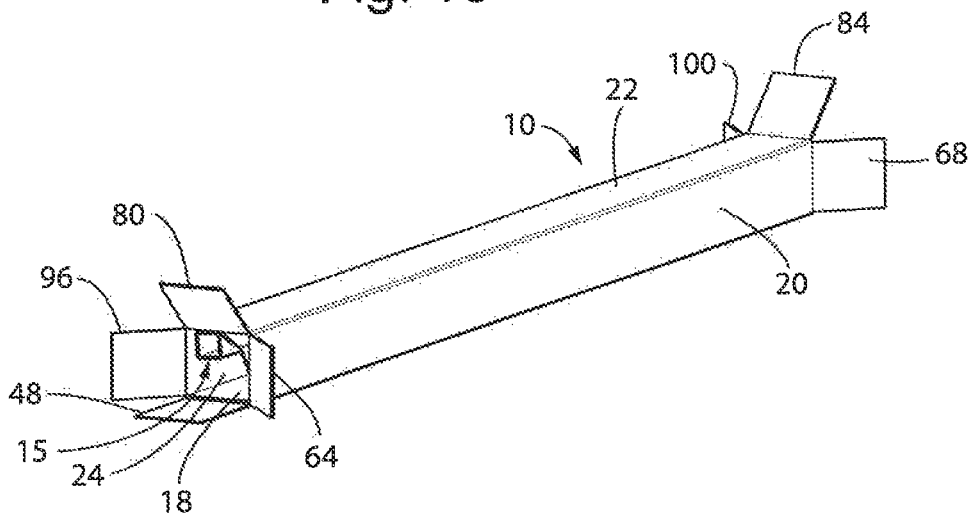
Figure 18:
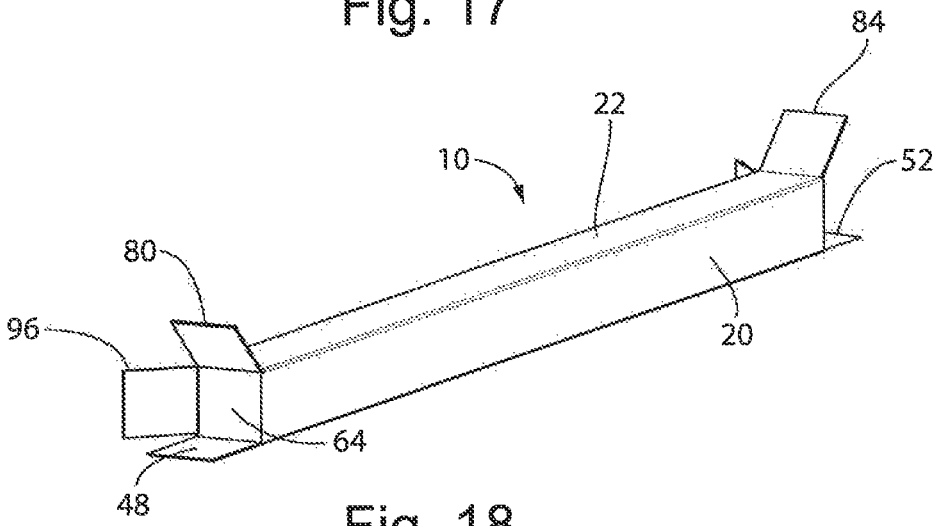
Figure 19:
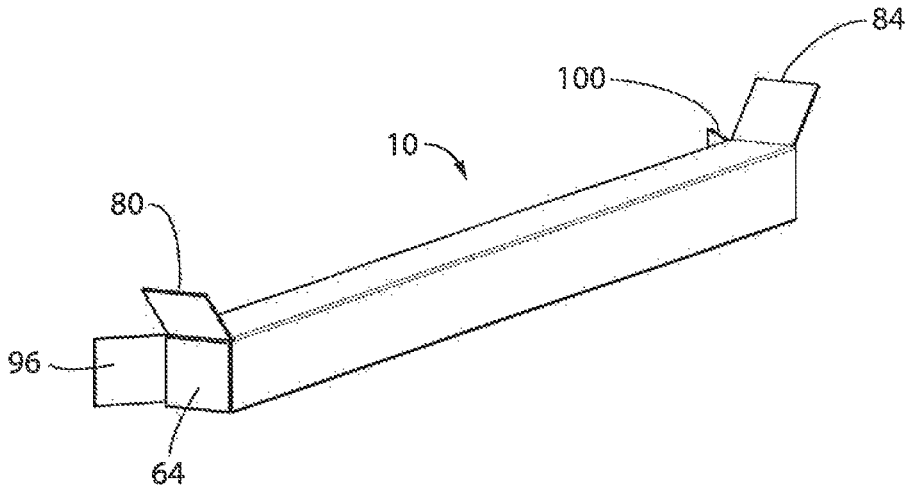
Figure 20:
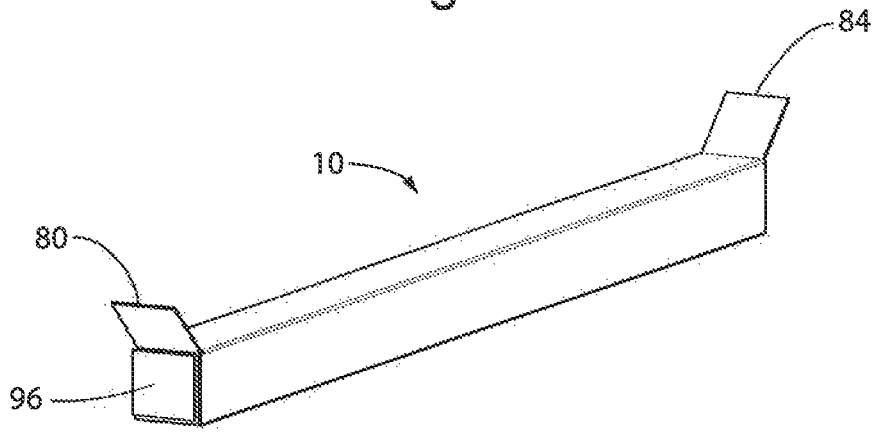
Figure 21:
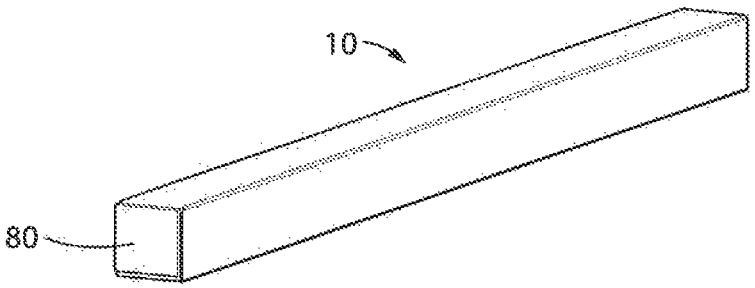

As shown in FIGS. 12 and 13, after the article A has been secured, the user continues to roll the sections 118, 120 and 122 of the blank 14 at fold lines 154, 162, 170, respectively. During this action, however, the sections are not folded tightly, i.e. they are simply formed so as to hang or cantilever the wrapped article A at fold line 106 so that the wrapped article A is suspended thereabove. At this point, the sections 18, 20, 22 and 24 are folded about a respective fold line 40, 58, 74 and 90 in order to form an outer protective elongated box about the suspended article A. This can be accomplished, as shown in FIGS. 14-17, by continuing the sequential folding and rolling action is generally described above so that the sections 18, 20, 22 and 24 are positioned generally perpendicularly relative to each other. In a final step, the endmost section 18 is positioned in overlapping relationship with the transition section 33 and the sections 18, 33 are secured together, such as by use of an adhesive or in any other satisfactory manner. The end sections 48, 64, 80, 96 and 52, 68, 84 and 100 are then folded inwardly onto each other and secured together as shown in FIGS. 18-21, again in a manner as is known, to enclose the ends of the container 10.

Figure 22:
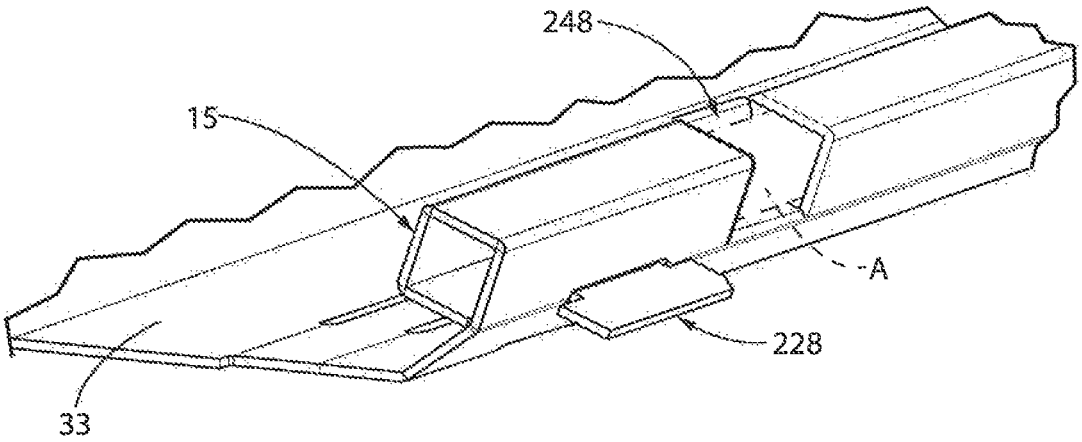
FIG. 22 is a partial isometric view illustrating a portion of the blank of FIGS. 3 and 4 during engagement of the areas of the blank with the elongated article.
Figure 23:
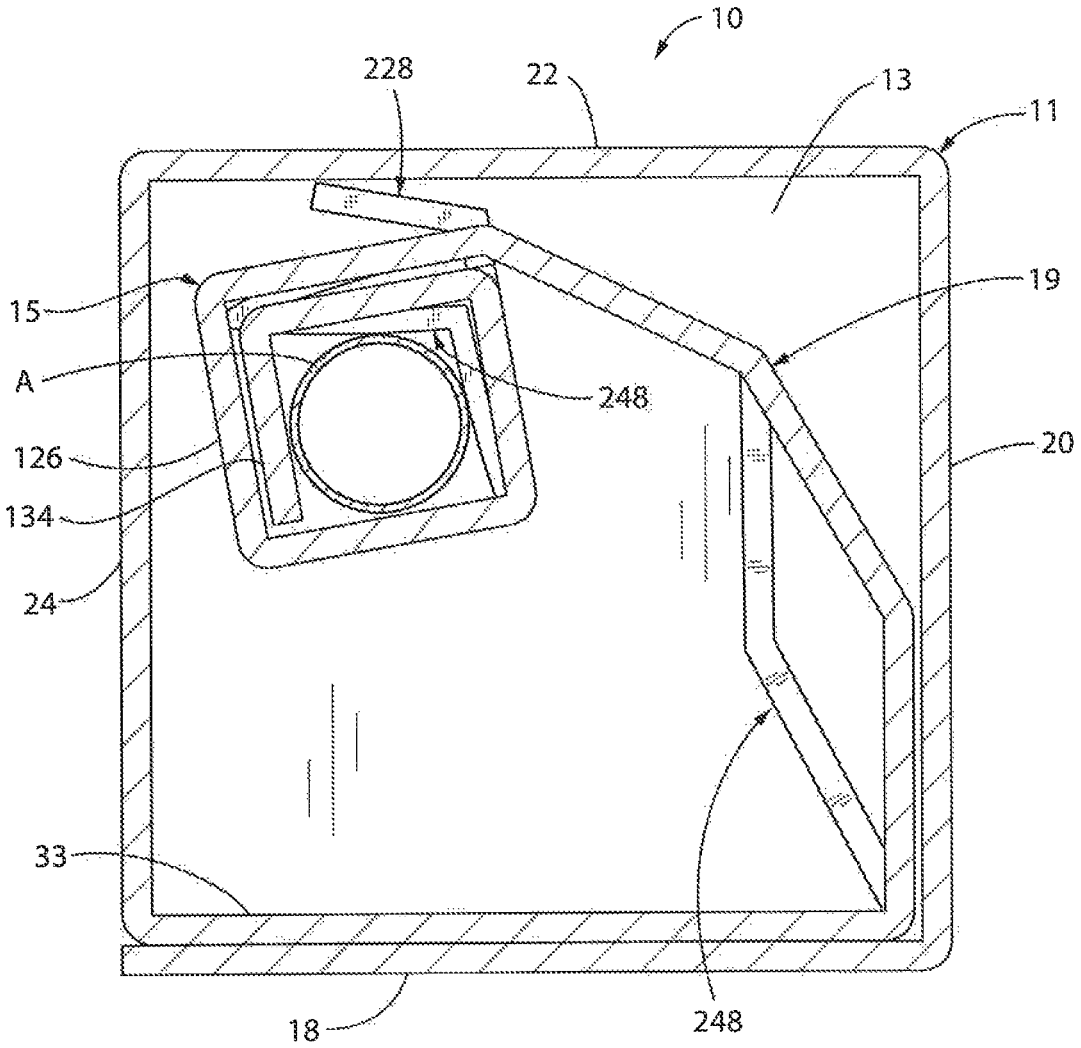
FIG. 23 is a section view similar to FIG. 2, illustrating use of positioning members for the elongated article and portions of the container.

Referring to FIG. 22, one of the sets of positioning sections 248 may be deformed inwardly into the passage 17 around the article A as the sections are being rolled and folded in order to form passage 17, to assist in maintaining article A in position and resisting axial movement of article A. As shown in FIG. 23, the other set of positioning sections 248 may be deformed inwardly relative to the remaining sections so as to provide a degree of support to the sections that function to hang or cantilever the wrapped article A within the cavity 13 of the container 10. The tabs 228 may come into contact with the inner surface of one of the container walls when the container 10 is fully formed, as also shown in FIG. 23. The tabs 228 thus function to space the wrapped article A inwardly relative to the container wall, and provide a degree of resiliency and cushioning in the event the suspended and wrapped article A is subjected to forces that might otherwise tend to bring it into contact with the container wall during shipping and handling. Other than this contact with one of the container walls, the wrapped article A is otherwise suspended within the cavity 13 and spaced from the container walls with a structure that bends and flexes in response to forces experienced by the container 10 while maintaining the article A out of contact with the container walls.

The present invention thus provides a relatively simple, inexpensive and uniquely configured way to package and ship elongated articles, as especially fragile elongated articles, using a single blank that both formed about the article A and that ultimately provides a protective outer shell. The invention provides a variably dimensioned article wrapping and engagement section, an outer container or shell section, and a transition section between the article engagement section and the outer shell section. In the illustrated embodiment, transition section 33 has been identified as providing the transition between the article engagement section and the outer shell section. It can be appreciated, however, that the transition structure between the outer shell section and the article engagement section may also be considered to include the sections that are located between the transition section 33 and the wrapped article A, such as the sections 118, 120, 122 that are not employed in wrapping about the article A.

It should be understood that the invention is not limited in its application to the details of construction and arrangements of the components set forth herein. The invention is capable of other embodiments and of being practiced for carried out in various ways. Variations and modifications of the foregoing are within the scope of the present invention.

It is also understood that the invention disclosed and defined herein extends to all alternative combinations of two or more of the individual features mentioned or evident from the text and/or drawings. All of these different combinations constitute various alternative aspects of the present invention. The embodiments described herein explained the best modes known for practicing the invention and will enable others skilled in the art to utilize the invention.

Various additions, modifications, and rearrangements are contemplated as being within the scope of the following claims, which particularly point out and distinctly claim the subject matter regarding as the invention, and it is intended that the following claims cover all such additions, modifications, and rearrangements.

We claim:

1. A shipping package for an elongated article that extends along a longitudinal axis, comprising:

an outer portion having a series of walls that cooperate to define a cavity that extends along the longitudinal axis;

an article receiving portion that defines a passage within which the elongated article is received; and a transition portion positioned between the outer portion and the article receiving portion, wherein the transition portion is interconnected with and extends from the outer portion and is interconnected with the article receiving portion, and wherein the transition portion is configured and arranged to suspend the article receiving portion within the cavity such that the article receiving portion is spaced from and not in contact with inner surfaces defined by the series of walls, wherein the article receiving portion is capable of moving within the cavity towards and away from the series of walls of the enter portion in response to at least one force experienced by the shipping package, and wherein the article remains suspended within the cavity and spaced apart from the walls of the outer portion of the shipping package during movement of the article receiving portion towards and away from the series of walls of the outer portion.

2. The shipping package of claim 1 wherein the article receiving portion and the transition portion are formed integrally with each other.

3. The shipping package of claim 1 wherein the outer portion and the transition portion are formed integrally with each other.

4. The shipping package of claim 1, wherein the article receiving portion, the transition portion and the outer portion are formed integrally with each other from a single blank of material.

5. The shipping package of claim 1, wherein the article receiving portion comprises a series of foldable panel sections that are configured to be wrapped about the article.

6. The shipping package of claim 5, wherein the article receiving portion includes a tab and slot arrangement for securing the foldable panel sections about the article.

7. The shipping package of claim 6, wherein the tab and slot arrangement comprises at least one tab and at least one set of slots that are spaced apart from each other, wherein the at least one tab is positionable within a selected one of the slots to vary a transverse dimension defined by the passage according to a transverse dimension defined by the article.

8. The shipping package of claim 5, wherein the transition portion comprises one or more panels that are interconnected with and extend between the article receiving portion and one of the walls of the outer portion.

9. A method of packaging an elongated article within a shipping package, wherein the article extends along a longitudinal axis, comprising the steps of:

positioning the article within a passage defined by an article receiving portion of the shipping package, wherein the article receiving portion of the shipping package is interconnected with a transition portion of the shipping package;

forming an outer portion of the package about the transition portion and the article receiving portion such that the article receiving portion is positioned within an interior defined by a series of walls defined by the outer portion of the package; and positioning the transition portion relative to the outer portion of the package so as to suspend the article receiving portion of the package within the interior of the outer portion, wherein the article receiving portion of the package is spaced from and not in contact with inner surfaces defined by the series of walls of the outer portion of the package, wherein the article receiving portion is capable of moving within the cavity towards and away from the series of walls of the outer portion in response to at least one force experienced by the shipping package, and wherein the article remains suspended within the cavity and spaced apart from the walls of the outer portion of the shipping package during movement of the article receiving portion towards and away from the series of walls of the outer portion.

10. The method of claim 9 wherein the article receiving portion and the transition portion are formed integrally with each other.

11. The method of claim 9 wherein the outer portion and the transition portion are formed integrally with each other.

12. The method of claim 9, wherein the article receiving portion, the transition portion and the outer portion are formed integrally with each other from a single blank of material.

13. The method of claim 9, wherein the article receiving portion comprises a series of foldable panel sections, and wherein the act of positioning the article within a passage defined by an article receiving portion of the shipping package is carried out by folding the foldable panel sections and wrapping the foldable panel sections about the article.

14. The method of claim 13, further comprising the act of utilizing a tab and slot arrangement for securing the foldable panel sections about the article.

15. The method of claim 14, wherein the tab and slot arrangement comprises at least one tab and at least one set of slots that are spaced apart from each other, and including the act of positioning at least one tab within a selected one of the slots to vary a transverse dimension defined by the passage according to a transverse dimension defined by the article.

16. The method of claim 13, wherein the transition portion comprises one or more panels that are interconnected with and extend between the article receiving portion and one of the walls of the outer portion.

* * * * *